US010345762B2

(12) United States Patent
Kissling et al.

(10) Patent No.: US 10,345,762 B2
(45) Date of Patent: Jul. 9, 2019

(54) TIMEPIECE WITH RETRACTABLE PUSHER

(71) Applicant: Omega SA, Biel/Bienne (CH)

(72) Inventors: Gregory Kissling, Macolin (CH); Jean Baebler, Guemligen (CH); Olivier Silvant, Macolin (CH); Sebastien Briswalter, Pfetterhouse (FR)

(73) Assignee: Omega SA, Biel/Bienne (CH)

( * ) Notice: Subject to any disclaimer, the term of this patent is extended or adjusted under 35 U.S.C. 154(b) by 28 days.

(21) Appl. No.: 15/666,969

(22) Filed: Aug. 2, 2017

(65) Prior Publication Data

US 2018/0046145 A1 Feb. 15, 2018

(30) Foreign Application Priority Data

Aug. 12, 2016 (EP) ..... 16184114

(51) Int. Cl.

| | |
|---|---|
| ***G04G 21/00*** | (2010.01) |
| ***G04B 19/28*** | (2006.01) |
| ***G04B 3/00*** | (2006.01) |
| ***G04B 3/04*** | (2006.01) |

(52) U.S. Cl.

CPC ..... *G04G 21/00* (2013.01); *G04B 3/001* (2013.01); *G04B 3/003* (2013.01); *G04B 3/043* (2013.01); *G04B 3/045* (2013.01); *G04B 3/048* (2013.01); *G04B 19/283* (2013.01)

(58) Field of Classification Search

CPC ..... G04G 21/00; G04B 19/283; G04C 3/001
USPC ..... 368/295, 319, 276, 283, 286, 288–289
See application file for complete search history.

(56) References Cited

U.S. PATENT DOCUMENTS

| | | | | |
|---|---|---|---|---|
| 6,200,019 | B1 * | 3/2001 | Latini | G04B 19/283 368/288 |
| 6,679,624 | B1 * | 1/2004 | Mouawad | G04B 3/041 368/190 |
| 2005/0254353 | A1 | 11/2005 | Cogoli et al. | |

FOREIGN PATENT DOCUMENTS

| | | |
|---|---|---|
| CH | 316833 | 10/1956 |
| CH | 700 535 A1 | 9/2010 |
| EP | 1 582 945 A2 | 10/2005 |
| JP | 2015-068778 | 4/2015 |

OTHER PUBLICATIONS

European Search Report dated Feb. 2, 2017 in European Application 18184114.3, filed on Aug. 12, 2016 (with English Translation of Categories of cited documents).

* cited by examiner

*Primary Examiner* — Edwin A. Leon
(74) *Attorney, Agent, or Firm* — Oblon, McClelland, Maier & Neustadt, L.L.P.

(57) ABSTRACT

A timepiece including a case middle, a bezel, rotatably mounted on the case middle, and an actuation member including a cover capable of adopting a retracted position and a deployed position relative to the case middle, the cover being provided with a bearing surface actuatable by the user's finger, wherein the cover includes a shoulder distinct from the bearing surface, the shoulder being intended to cooperate with the bezel when the cover is in the retracted position.

15 Claims, 8 Drawing Sheets

TIMEPIECE WITH RETRACTABLE PUSHER

This application claims priority from European Patent Application No. 16184114.3 filed on Aug. 12, 2016, the entire disclosure of which is hereby incorporated herein by reference.

SUBJECT OF THE INVENTION

The present invention relates to a timepiece provided with a mechanism for retracting an actuation member, and, in particular, a chronograph pusher, when it is not in operation.

BACKGROUND OF THE INVENTION AND PRIOR ART

To avoid inadvertent activation of watch chronographs and damage to the associated control members, such as pushers, it is preferable to cover the latter when they are not being used by the user. Various systems are proposed to this end. There are covers integral with the rotating bezel as described in CH Patent 567300, where the bezel is provided with a bearing surface which, depending on the angular position of the bezel, respectively does or does not cover the pushers. The drawback of these systems is that they are bulky and unattractive. There also exist systems with retractable pushers like those described in EP Patent 1582945, where the displacement of the pusher between a retracted position and a deployed position is related to the angular displacement of a wall integral with the bezel. In this invention, the wall covers and compresses the pusher towards the case interior when facing the pusher and conversely releases it into an external position ready for use when the wall is not facing the pusher. The drawback of this system is that friction, which is greater in the presence of dust, is constantly produced between the outer surface of the pusher and the bezel wall during the rotational motion of the bezel. Over time, unsightly grooves will appear on a portion of the pusher that is visible to the user when the pusher is in the deployed position.

SUMMARY OF THE INVENTION

It is an object of the present invention to overcome the drawbacks of the state of the art by producing a timepiece provided with a retraction mechanism that does not require any relative movement between the visible outer surface of the pusher and the part cooperating with the latter during retraction.

To this end, there is proposed a timepiece according to the attached claim 1, and particular embodiments are covered in the dependent claims.

BRIEF DESCRIPTION OF THE DRAWINGS

The features and advantages of the present invention will appear upon reading the detailed description hereinafter, with reference to the following Figures.

FIGS. 1 and 2 respectively represent a perspective view and a top view of the watch. FIG. 3 is a half cross-section. FIGS. 4 and 5 are respectively cross-sectional views along axis A-A and axis B-B of FIG. 2.

DETAILED DESCRIPTION OF THE INVENTION

The present invention relates to a timepiece of the wristwatch type provided with one or more pushers intended to actuate a function such as, for example, a chronograph function. According to the invention, the wristwatch is provided with means for retracting the pushers when they are not in operation.

Figure 1:
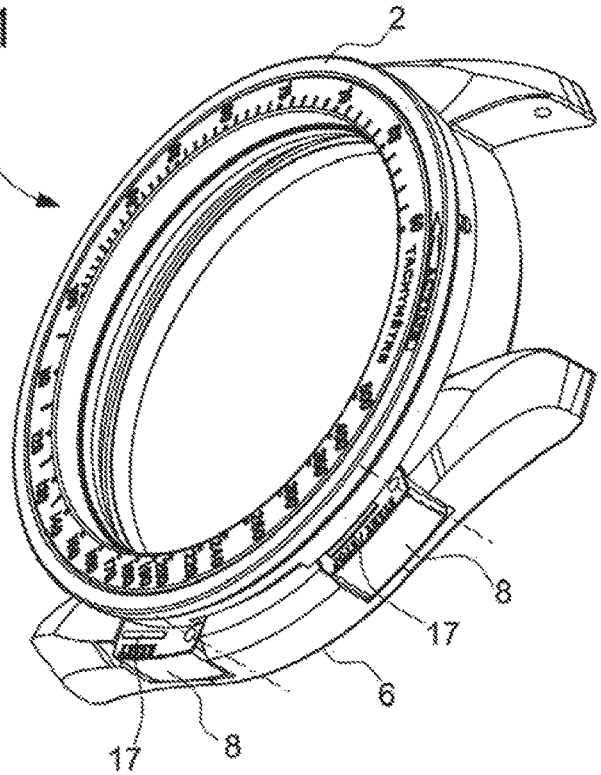
FIGS. 1 to 5 represent different views of the watch with the retracted pushers according to the invention.
Figure 2:
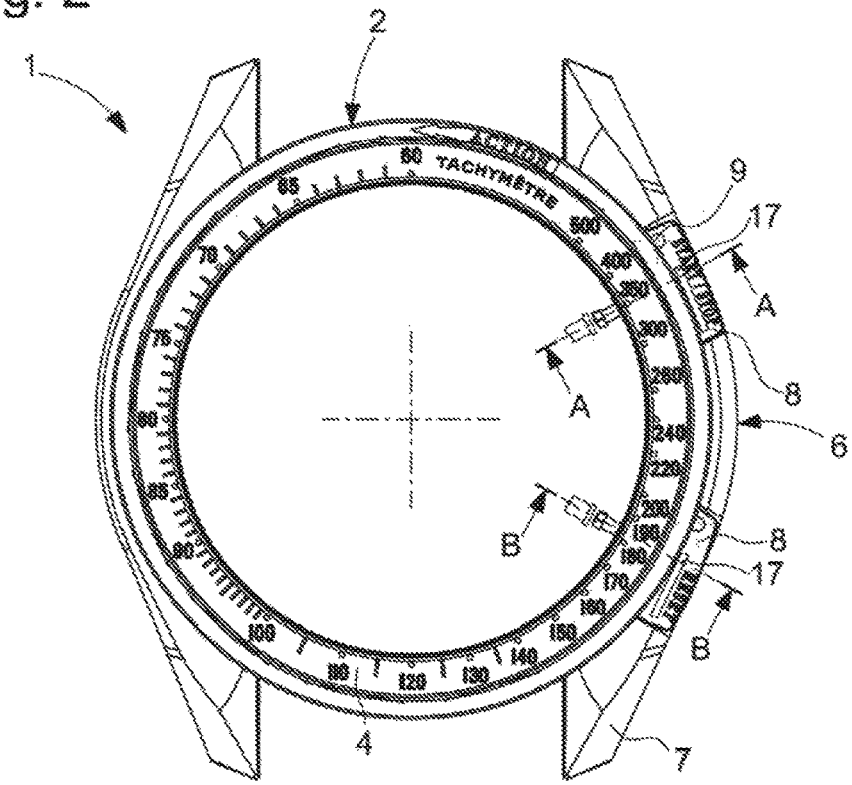
Figure 17:
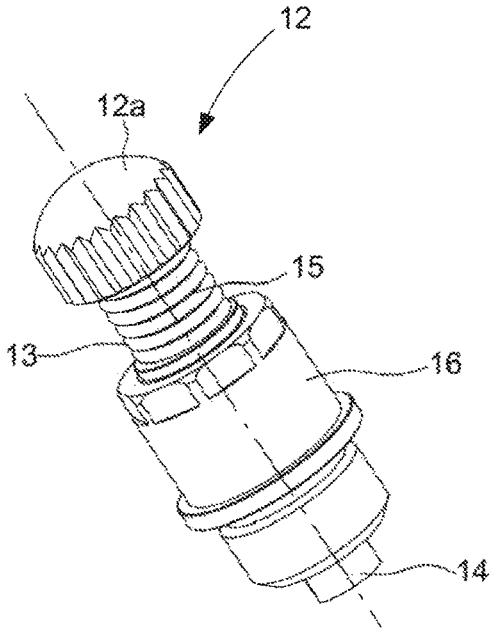
FIG. 17 is a perspective view of the pusher according to the invention.

The wristwatch 1 seen, inter alia, in FIGS. 1 and 2, includes a bidirectional rotating bezel 2 rotably mounted on a case middle 6 in a conventional manner. In the example represented, bezel 2 includes a cylindrical inner bearing surface 2*a* fitted onto a cylindrical outer bearing surface 6*a* of the case middle to ensure that the bezel is guided in rotation on case middle 6 (see FIG. 4). The axial retention of bezel 2 on the case middle is ensured by a ring 3 disposed inside a housing L partially formed in cylindrical inner bearing surface 2*a* of the bezel and in cylindrical outer bearing surface 6*a* of the case middle when the bezel is in place on the case middle. More precisely, housing L is formed by annular radial grooves respectively provided in the cylindrical inner bearing surface of the bezel and in the cylindrical outer bearing surface of the case middle, one facing the other, the ring being mounted inside this housing so that it extends, in a mounted position, both in the bezel groove and in the case middle groove. Case middle 6 includes graduations on its upper peripheral surface and, for example, fixed tachymeter graduations. The actuation member for the function to be started includes a cover 8 protecting a pusher 12 represented in detail in FIG. 17. Pusher 12 includes, in a conventional manner, an actuating head 12*a* fixed to one end of a stem 15, which is guided in translation and returned by a spring 13 inside a tube 16, screwed, in a sealed manner, into case middle 6. As shown, inter alia, in FIGS. 4 and 5, the opposite end of stem 15 extending inside the case middle is intended to cooperate with a member 4 for controlling the function associated with pusher 12.

According to the invention, cover 8 is movably mounted and can respectively adopt a deployed position outside case middle 6, a retracted position inside case middle 6, and an operating position which is also inside the case middle but has a greater travel inside the case middle than in the retracted position. Cover 8 may be mounted to pivot as represented in FIGS. 1 to 16. According to another embodiment (not represented), cover 8 could be mounted in translation on the case middle.

In the illustrated example, cover 8 is mounted to pivot about an arbor 9 integral with case middle 6. Preferably, cover 8 extends into a recess in the case middle. A first position illustrated in FIGS. 1 to 5 is the retracted position, where cover 8 is housed inside the recess and its upper surface is flush with the outer surface of case middle 6 for aesthetic reasons and to avoid snagging. A second position is the deployed position, where cover 8 is free to move and pivots towards the outside of case middle 6 (FIGS. 6 to 10). The operating position ensues from this position where, following actuation by the user, cover 8 pivots towards the inside of case middle 6 to start the associated function (FIGS. 11 to 14).

According to the invention, the displacement of the cover between the retracted position and the deployed position is coupled to the angular displacement of bezel 2. Cover 8 and bezel 2 have a particular profile which ensures cooperation between these two components, as will be described below.

Figure 3:
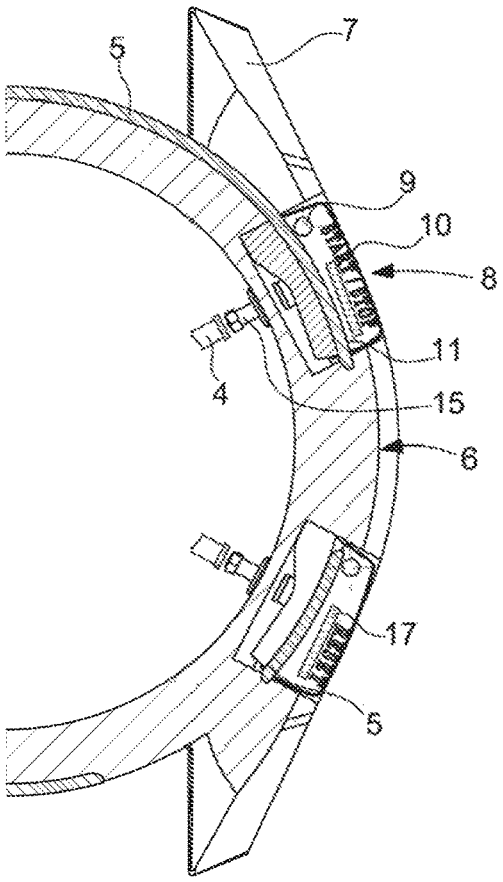
Figure 4:
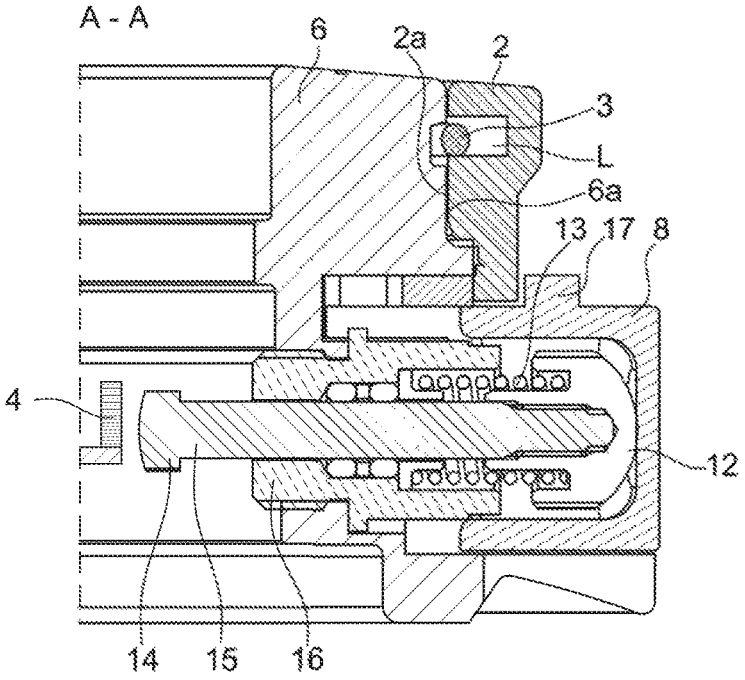
Figure 5:
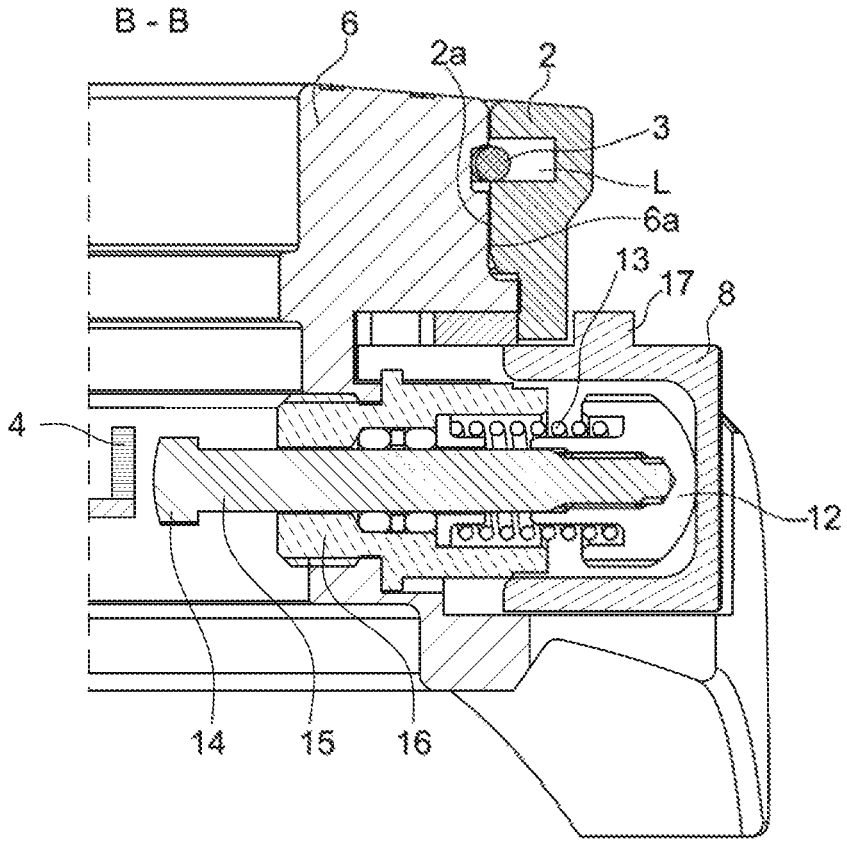
Figure 6:
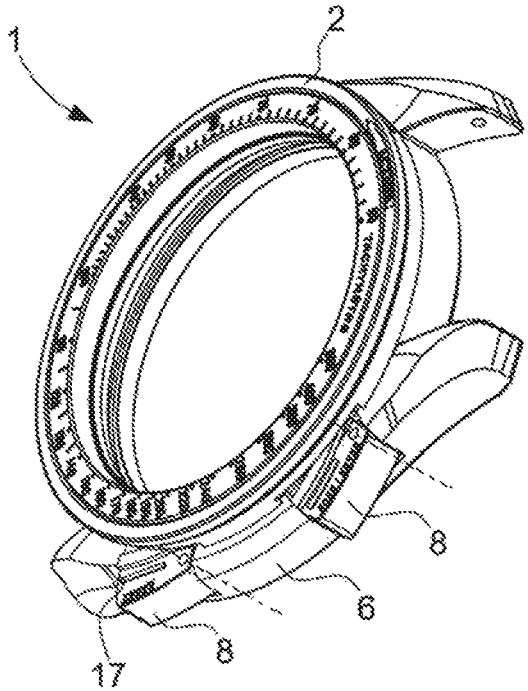
FIGS. 6 to 10 respectively correspond to FIGS. 1 to 5 above, but with the pushers deployed according to the invention.
Figure 7:
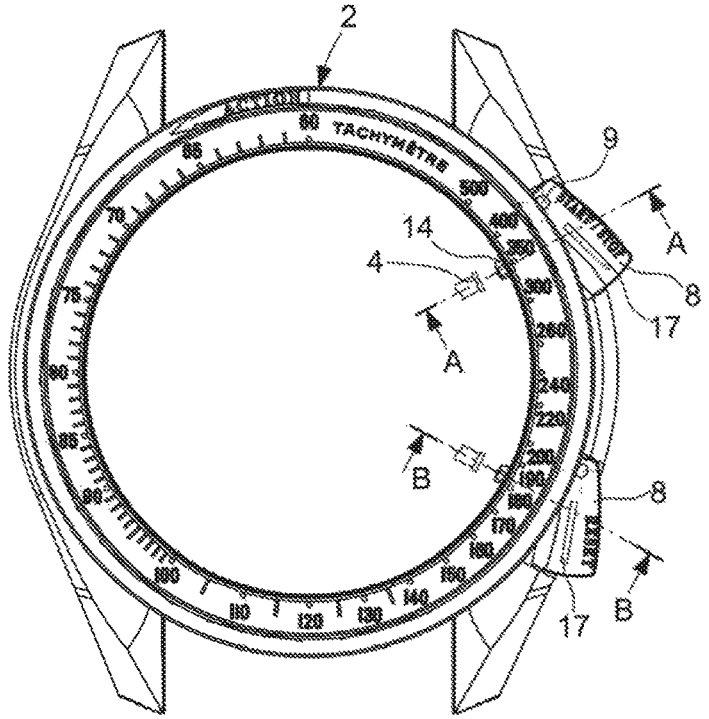
Figure 15:
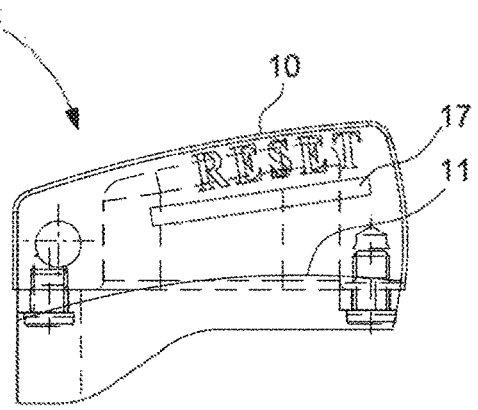
FIGS. 15 and 16 are respectively a lateral view and a perspective view of the cover of the pusher of the invention.
Figure 16:
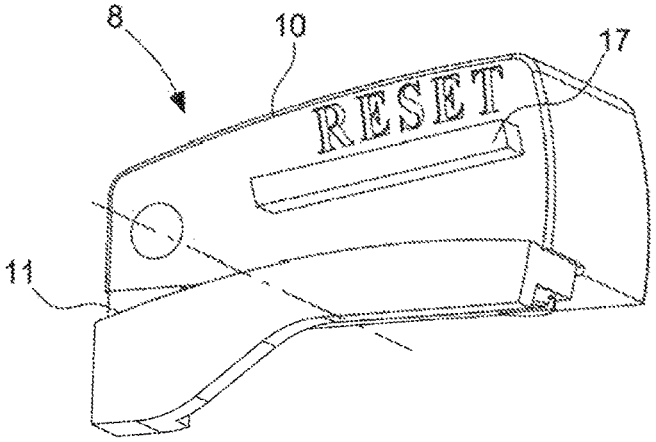

Cover 8, visible in detail in FIGS. 15 and 16, is surmounted by bearing surface 10 which is actuatable by the user's finger. On a lateral surface, cover 8 includes a shoulder 11, which is distinct from bearing surface 10 and forms a guide surface preferably having an arc-shaped profile cooperating with bezel 2 during the rotation of the latter. To this end, on a portion of its periphery, bezel 2 includes a skirt portion defining rims 5 projecting towards the back cover of the wristwatch and moving over the guide surface of the various covers (FIGS. 3 to 5). These arc-shaped rims 5 disposed at intervals on the bezel perimeter extend around the outer lateral surface of case middle 6 above horns 7 of the case middle.

Figure 8:
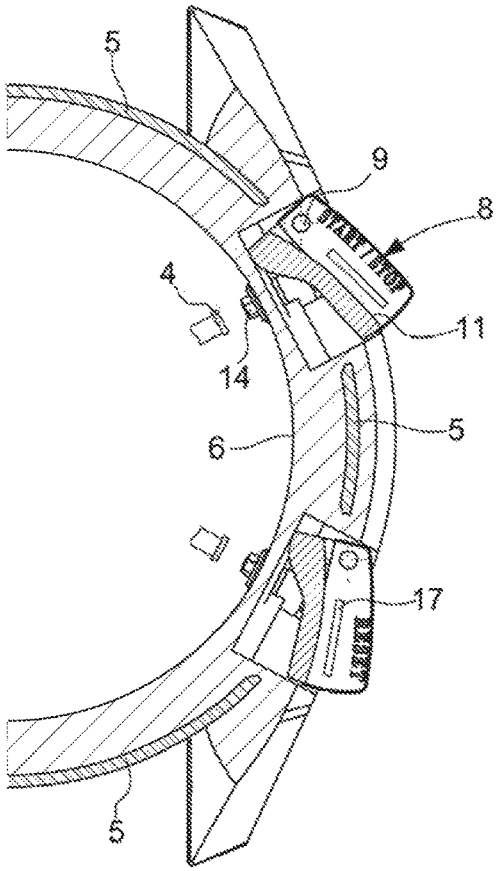
Figure 9:
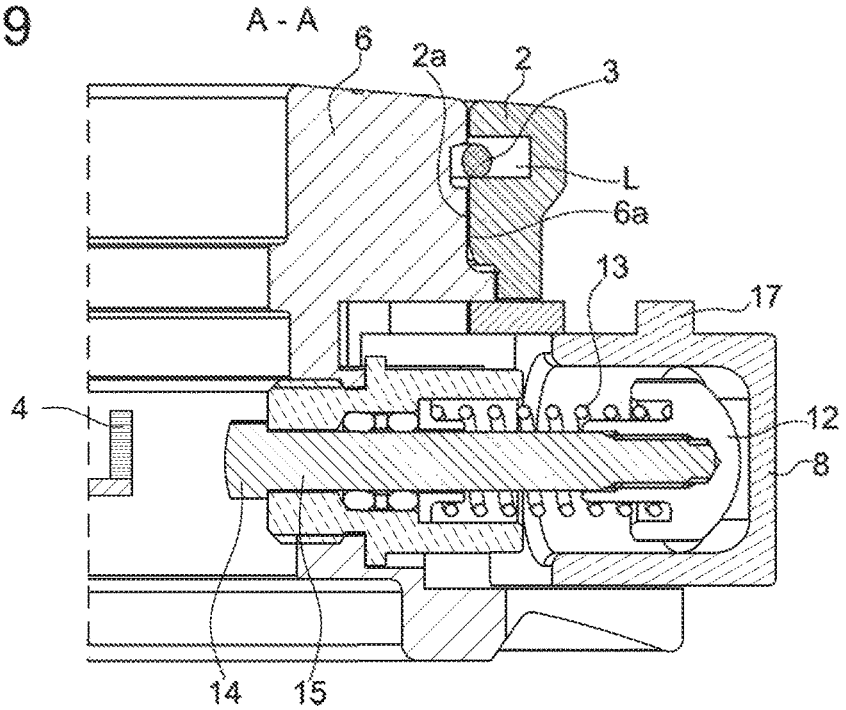
Figure 10:
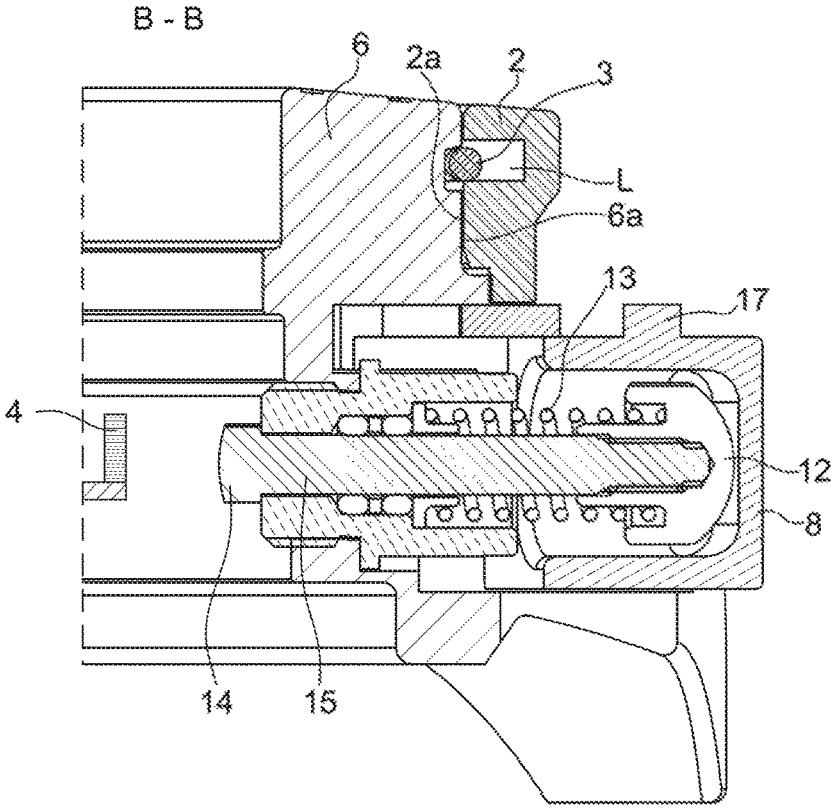
Figure 11:
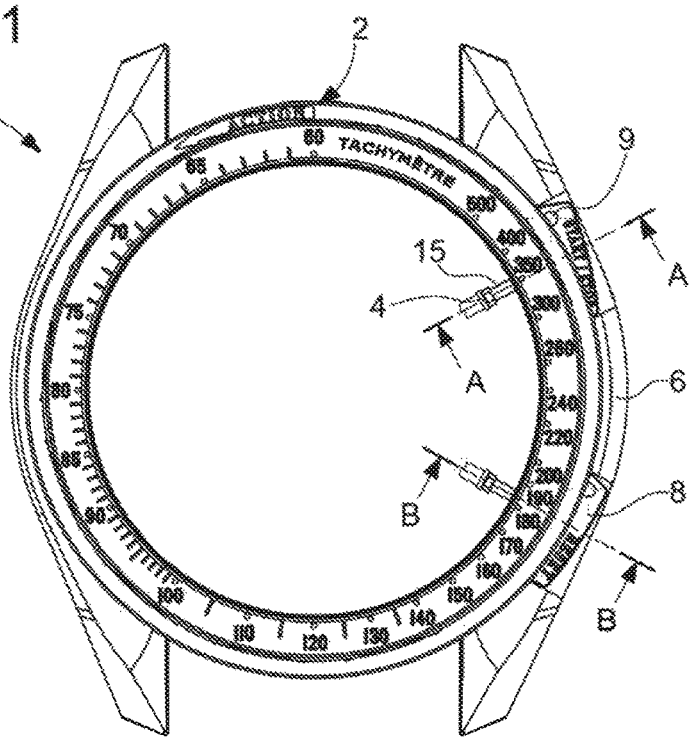
FIGS. 11 to 14 respectively correspond to FIGS. 2 to 5 above, but with the pushers in operation, i.e. actuated by the user to start the required function, according to the invention.
Figure 12:
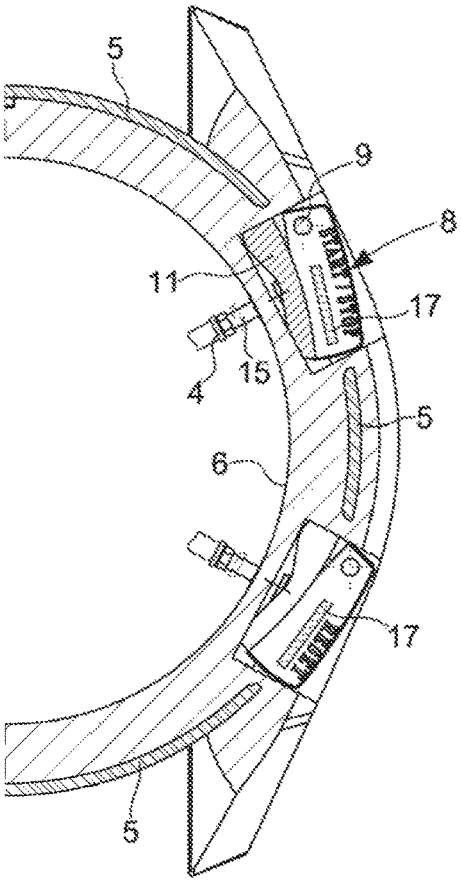
Figure 13:
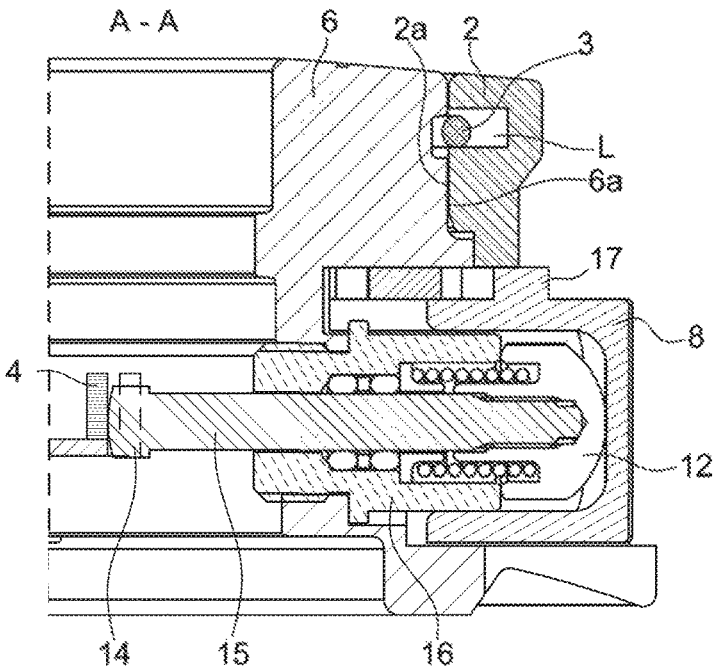
Figure 14:
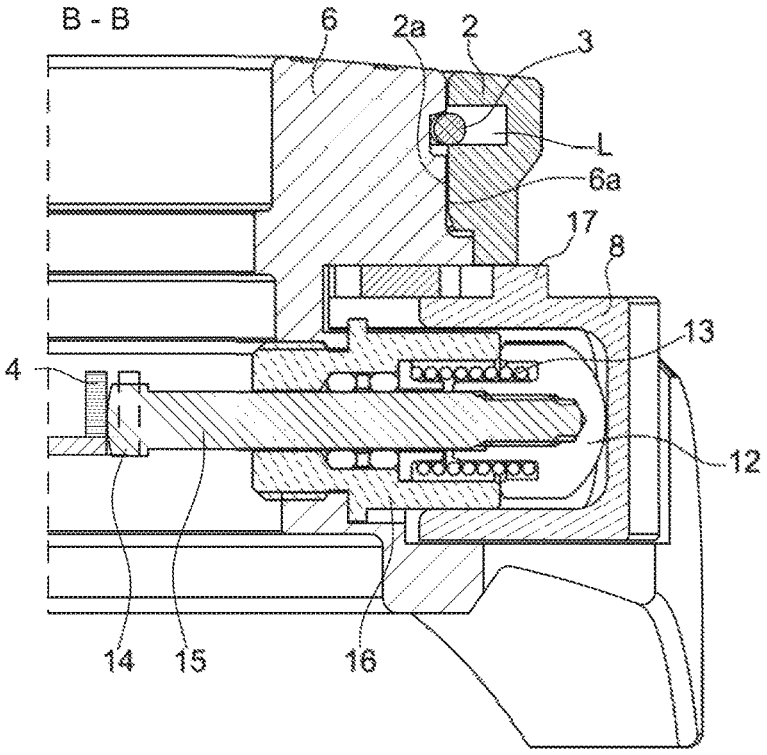

Rims 5 are arranged on the periphery of the bezel such that, in the neutral bezel position, they face covers 8 to cooperate with shoulders 11, as illustrated in FIG. 3. In this configuration, each cover 8 is held in a retracted position by a rim 5 resting on its shoulder 11. When the bezel rotates at a given angle, which is a function of the length of the rims and the gap between the rims, the latter are no longer in contact with cover 8, as shown in FIG. 8. Consequently, under the effect of spring 13 of pusher 12, cover 8 pivots towards the outside of case middle 6 (FIGS. 8 to 10). The maximum outward travel of cover 8 is limited by its outer lateral wall on the side of its pivot arbor 9 which abuts against a lateral surface of the recess in case middle 6 in which cover 8 is mounted, as shown in FIG. 8. The cover is thus in a deployed position and can be actuated by the user. Accordingly, cover 8 pivots towards the inside of case middle 6 with a maximum travel which is limited by the displacement of pusher 12 abutting on the fixed tube 16 surrounding stem 15 (FIGS. 11 to 14).

Each shoulder 11 offers a guide surface devised to facilitate engagement of the rim on the shoulder when cover 8 switches from the deployed position of FIG. 8 to the retracted position of FIG. 3. To facilitate this engagement, shoulder 11 must be skewed relative to bezel 2 when cover 8 is in the deployed position. This skewed configuration may result from pivoting, as illustrated in FIG. 8, or be obtained by providing a shoulder 11 with the required inclination inside the cover, in the case of a cover mounted to move in translation.

Preferably, locking means 17 are provided so that the user cannot actuate the control member by pressing on the bearing surface when cover 8 is in the retracted position. The locking means 17 may include a stop integral with the bezel or with the case middle limiting the travel of the cover inside the case middle. Further, to prevent the bezel moving freely outside of the determined angular positions corresponding to the retracted and deployed positions of the cover, the watch is provided with locking means of a known type, such as spring-loaded balls. The watch further includes means for limiting the angular displacement of the bezel to avoid the bezel rotating in the wrong direction and damaging the covers and rims, when it is deployed. For example, the means may be stops mounted on the case middle cooperating with the bezel.

By way of illustration, the present invention has been described for a wristwatch having two pushers with respective arbors arranged at +28° and −28° with respect to the 3 o'clock position, wherein a 30° angular displacement of the bezel results in a change of position of the pushers. It is evident that other configurations are covered by the present invention. Likewise, in the illustrated example, the covers simultaneously pivot towards the outside of the case middle in the anticlockwise direction when the bezel rotates anticlockwise. Conversely, the pivot arbors may be arranged so that the covers are deployed in the clockwise direction when the bezel rotates clockwise.

Finally, it will be specified, with regard to pusher cover 8, that the shoulder can be arranged inside the cover or formed by adding a component to a conventional pusher cover, as shown in FIG. 16. Thus, the cover and the pusher may form two distinct components as in the illustrated example, or form a single element, in particular for the embodiment with the cover mounted to move in translation, wherein the pusher and the cover can move together in translation.

ADVANTAGES OF THE INVENTION

As a result of the retraction mechanism according to the invention, the bearing surface of cap 8 is not subjected to friction during the angular displacement of bezel 2. Only the shoulder, which is not visible from outside the case middle when the pusher is retracted, cooperates with the bezel and is thus likely to be scratched. It follows that the pusher cover does not suffer excessive wear due to use of the pusher. Thus, simply the component forming the shoulder can be made of a wear resistant material, which may be, for example, a ceramic or any other material having similar wear resistance.

In the example described above, the user directly rotationally actuates the bezel manually, but it is evident that in a variant that is not represented, the bezel could be rotated by a mechanism of the pusher/lever type or by a knob mechanism kinematically connected to the bezel via a toothed wheel or suchlike.

LIST OF PARTS (1) Timepiece and, in particular, a wristwatch
(2) Bezel
  (2*a*) Cylindrical inner bearing surface of the bezel
(3) Ring
(4) Member controlling the function to be actuated
(5) Bezel rim
(6) Case middle
  (6*a*) Cylindrical outer bearing surface of the case middle
(7) Horn of the caseband
(8) Pusher cover
(9) Pivot arbor of the cover
(10) Bearing surface of the cover
(11) Shoulder, also called guide surface, of the cover
(12) Pusher, also called actuation member
  (12*a*) actuating head of the pusher
(13) Pusher spring
(14) Stop and, in particular, nut of the pusher
(15) Pusher stem
(16) Tube
(L) housing

What is claimed is:

1. A timepiece comprising:
a case middle,
a bezel rotatably mounted on the case middle, and
an actuation member comprising a cover capable of adopting a retracted position and a deployed position relative to the case middle, said cover being provided with a bearing surface actuatable by the user's finger, wherein the cover comprises a shoulder distinct from the bearing surface, said shoulder forming an arc-shaped guide surface and being intended to cooperate with the bezel when the cover is in the retracted position, and wherein the cover is mounted to pivot about a pivot arbor of the cover, the pivot arbor being integral with the case middle and arranged such that the cover pivots during the displacement between the retracted position and the deployed position.

2. The timepiece according to claim 1, configured such that, in the retracted position, the bearing surface is flush with an outer lateral surface of the case middle.

3. The timepiece according to claim 1, configured such that the displacement between the retracted position and the deployed position of the cover is coupled to the angular displacement of the bezel, said bezel being provided with an arc-shaped rim disposed on a portion of the periphery thereof and intended to cooperate with the shoulder when the cover adopts the retracted position.

4. The timepiece according to claim 3, wherein said rim covers a portion of an outer lateral surface of the case middle up to the height of the horns of the case middle.

5. The timepiece according to claim 1, configured such that, after actuating said member by pressing on the bearing surface, the cover adopts a position which is distinct from the retracted position and wherein the cover is positioned inside the case middle.

6. The timepiece according to claim 1, wherein, during the displacement between the retracted position and the deployed position, the bezel and the cover move angularly in the same direction whether it is clockwise or anticlockwise.

7. The timepiece according to claim 1, comprising means for locking the actuation member when the cover is in the retracted position.

8. The timepiece according to claim 1, wherein the shoulder is arranged such that, when the cover is in the deployed position, the shoulder is skewed with respect to the bezel with one end closer to the centre of the case middle than the rim.

9. The timepiece according to claim 1, wherein the shoulder is made of a ceramic material.

10. The timepiece according to claim 1, comprising means for limiting the angular displacement of the bezel in the clockwise direction and in the anticlockwise direction.

11. The timepiece according to claim 1, wherein the actuation member comprises a stem coupled at one end to the cover and integral with a stop at the other end, the maximum travel of the cover towards the outside of the case middle being limited by its outer lateral wall on the side of its pivot arbor which abuts against a lateral surface of a recess in the case middle wherein the cover is mounted when the cover adopts a deployed position.

12. The timepiece according to claim 11, wherein the actuation member comprises a fixed tube surrounding said stem and making it possible to limit the maximum travel of the cover inside the case middle when the cover is actuated by the user.

13. The timepiece according to claim 1, comprising several covers and, wherein the bezel comprises several rims disposed at intervals on the bezel perimeter.

14. The timepiece according to claim 1, comprising two covers respectively disposed at plus 28° and minus 28° with respect to the 3 o'clock position on the timepiece, wherein an angular displacement of the bezel on the order of 30° ensures the displacement of the covers between the retracted and deployed positions.

15. The timepiece according to claim 1, wherein said cover has a U shape formed by two arms extending into the case middle and a base that connects the two arms, an outer face of the base forms the bearing surface, and an inner face of the base directly contacts an actuating head of a pusher positioned within the cover to start a function of the timepiece associated with the pusher.

* * * * *